US009846388B2

(12) United States Patent
Suenami et al.

(10) Patent No.: US 9,846,388 B2
(45) Date of Patent: Dec. 19, 2017

(54) DEVELOPING DEVICE INCLUDING A GUIDE PORTION AND AN IMAGE FORMING APPARATUS PROVIDED WITH THE SAME

(71) Applicant: KYOCERA Document Solutions Inc., Osaka-shi, Osaka (JP)

(72) Inventors: Koji Suenami, Osaka (JP); Yukihiro Mori, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/446,312

(22) Filed: Mar. 1, 2017

(65) Prior Publication Data

US 2017/0255128 A1 Sep. 7, 2017

(30) Foreign Application Priority Data

Mar. 2, 2016 (JP) ..... 2016-039528

(51) Int. Cl.
*G03G 15/08* (2006.01)
*G03G 15/09* (2006.01)

(52) U.S. Cl.
CPC ..... *G03G 15/0889* (2013.01); *G03G 15/0812* (2013.01)

(58) Field of Classification Search
CPC ..... G03G 15/0889; G03G 15/0812
USPC ..... 399/254, 256, 272, 281
See application file for complete search history.

(56) References Cited

U.S. PATENT DOCUMENTS 8,831,486 B2 * 9/2014 Toichi ..... G03G 15/0812 399/267
2013/0071145 A1 3/2013 Toichi

FOREIGN PATENT DOCUMENTS

JP 2013064781 A 4/2013

* cited by examiner

*Primary Examiner* — William J Royer
(74) *Attorney, Agent, or Firm* — Alleman Hall Creasman & Tuttle LLP

(57) ABSTRACT

A developing device includes a storage portion, a developer carrying member, a stirring portion, a layer thickness restricting portion, and a guide portion. The guide portion is disposed between the stirring portion and the layer thickness restricting portion. The stirring portion faces the developer carrying member with a first gap between them. The layer thickness restricting portion faces the developer carrying member with a second gap between them. The guide portion includes a first guide surface and a second guide surface. On the first guide surface, convex portions or concave portions are formed. The first guide surface faces the stirring portion with, between them, a third gap that is a passage through which the developer passes toward the first gap. The second guide surface faces the developer carrying member with, between them, a fourth gap that is a passage through which the developer passes toward the second gap.

9 Claims, 7 Drawing Sheets

DEVELOPING DEVICE INCLUDING A GUIDE PORTION AND AN IMAGE FORMING APPARATUS PROVIDED WITH THE SAME

INCORPORATION BY REFERENCE

This application is based upon and claims the benefit of priority from the corresponding Japanese Patent Application No. 2016-039528 filed on Mar. 2, 2016, the entire contents of which are incorporated herein by reference.

BACKGROUND

The present disclosure relates to a developing device and an image forming apparatus.

In general, a developing device of an electrophotographic system includes a storage portion that stores developer, a developer carrying member of a cylindrical shape, a magnet disposed in a hollow portion of the developer carrying member, a stirring portion configured to stir the developer, and a layer thickness restricting portion configured to restrict the layer thickness of the developer on the developer carrying member.

The stirring portion is of a screw feeder type and includes a shaft portion and a blade portion spirally extending outward from the shaft portion. The developer carrying member is referred to as a magnetic roller, a magnetic sleeve or the like.

It is known that, on the surface of the developer carrying member, streaky density unevenness of the developer may be formed along the blade portion of the stirring portion. In particular, in a case where the developer includes toner of a low-melt-type whose melting point is low, the density unevenness is likely to occur due to the stirring portion.

In addition, it is known that a restriction plate facing the outer circumferential surface of the developer carrying member may be provided on the upstream side of the layer thickness restricting portion in the rotation direction of the developer carrying member, and that a projection portion is formed on the surface of the restriction plate.

The restriction plate compresses the developer carried by the developer carrying member by gradually narrowing the passage of the carried developer. The projection portion moderates the density unevenness of the developer on the outer circumferential surface of the developer carrying member.

SUMMARY

A developing device according to an aspect of the present disclosure includes a storage portion, a developer carrying member, a stirring portion, a layer thickness restricting portion, and a guide portion. The storage portion stores developer including toner. The developer carrying member is of a cylindrical shape, has a magnet in an inside thereof, and rotates in the storage portion while carrying the developer on an outer circumferential surface thereof. The stirring portion includes a blade portion spirally extending outward, the stirring portion facing the developer carrying member with a first gap therebetween and stir the developer in the storage portion by rotating. The layer thickness restricting portion is located on a downstream side of the stirring portion in a rotation direction of the developer carrying member. The layer thickness restricting portion faces the developer carrying member with a second gap therebetween and restricts a layer thickness of the developer carried by the developer carrying member. The guide portion is disposed between the stirring portion and the layer thickness restricting portion. The guide portion includes a first guide surface and a second guide surface. On the first guide surface, a plurality of convex portions or a plurality of concave portions are formed. The first guide surface faces the stirring portion with, between them, a third gap that is a passage through which the developer passes toward the first gap. The second guide surface faces the developer carrying member with, between them, a fourth gap that is a passage through which the developer passes toward the second gap.

An image forming apparatus according to another aspect of the present disclosure includes an image carrying member, the developing device, a transfer device, and a fixing device. On a surface of the image carrying member, an electrostatic latent image is formed. The developing device develops, as a toner image, the electrostatic latent image on the surface of the image carrying member. The transfer device transfers the toner image to a sheet. The fixing device heats the toner image transferred to the sheet.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

First Embodiment: Configuration of Image Forming Apparatus 10

Figure 1:
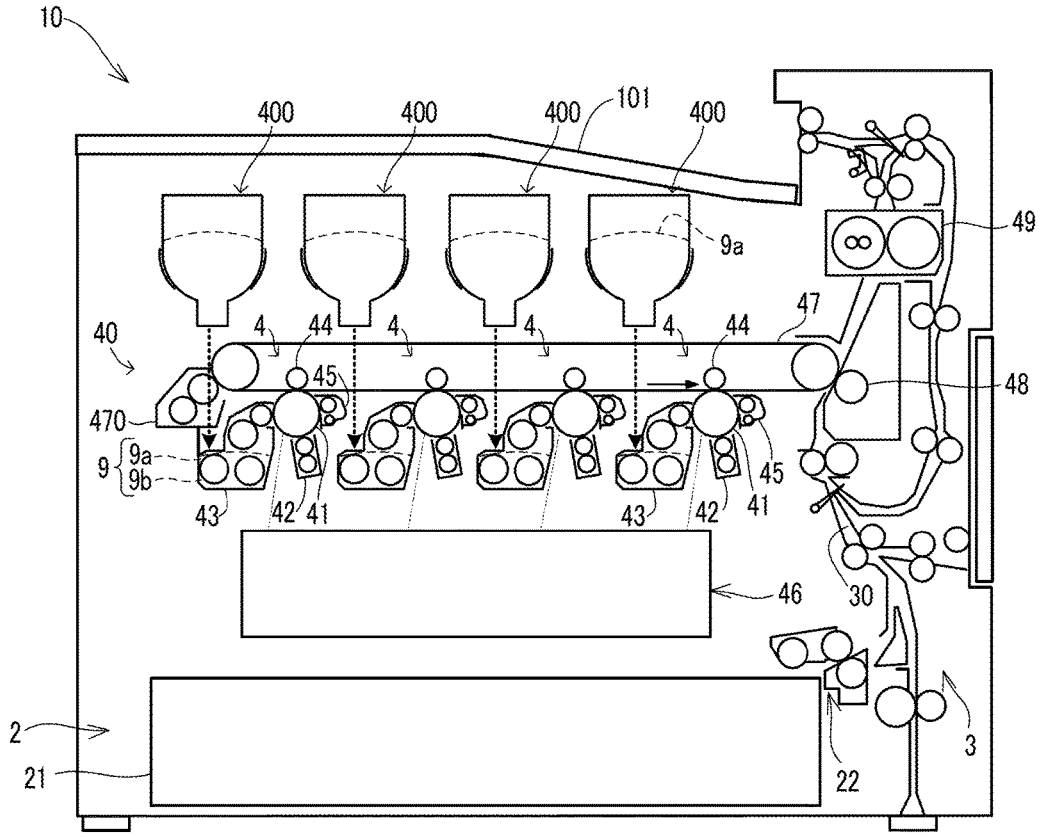
FIG. 1 is a configuration diagram of an image forming apparatus including a developing device according to a first embodiment.

First, a description is given of a configuration of an image forming apparatus 10 including a developing device 43 according to the first embodiment of the present disclosure, with reference to FIG. 1.

The image forming apparatus 10 forms an image on a sheet by an electrophotographic system using developer 9. The sheet is a sheet-like image formation medium such as a sheet of paper or an envelope. The developer 9 is two-component developer that includes toner 9*a* and carrier 9*b*. The carrier 9*b* is a granular material having magnetism.

The image forming apparatus 10 includes a sheet supply portion 2, a sheet conveying portion 3, an image forming portion 40, and a toner supply portion 400. The image forming portion 40 includes image forming units 4, a laser scanning portion 46, and a fixing device 49. The image forming portion 40 executes a print process to form an image on the sheet.

In the sheet supply portion 2, a sheet feed portion 22 feeds sheets one by one from a sheet cassette 21 that stores a plurality of sheets, to a conveyance path 30. Furthermore, the sheet conveying portion 3 conveys the sheet along the conveyance path 30, and discharges the sheet with an image formed thereon from the conveyance path 30 onto a discharge tray 101.

The image forming units 4 perform a developing process using the powdery developer 9 and a primary transfer process. The image forming apparatus 10 shown in FIG. 1 is a tandem-type image forming apparatus and is a color printer. The image forming apparatus 10 thus includes a plurality of image forming units 4 that respectively correspond to colors of cyan, magenta, yellow, and black, an intermediate transfer belt 47, a secondary transfer device 48, and a secondary cleaning device 470.

Each of the image forming units 4 includes a photoconductor 41, a charging device 42, a developing device 43, a primary transfer device 44, and a primary cleaning device 45.

In each of the image forming units 4, the drum-like photoconductor 41 rotates and the charging device 42 uniformly charges the surface of the photoconductor 41. The laser scanning portion 46 writes an electrostatic latent image on the charged surface of the photoconductor 41 by scanning a laser beam thereon. It is noted that the photoconductor 41 is an example of the image carrying member on which the electrostatic latent image is formed.

The developing device 43 develops the electrostatic latent image on the photoconductor 41 as an image of the toner 9*a*, by using the two-component developer 9. The toner supply portion 400 is provided for each color of the toner 9*a*, and supplies the toner 9*a* to a corresponding one of the developing devices 43.

The primary transfer device 44 transfers the image of the toner 9*a* from the surface of the photoconductor 41 to the intermediate transfer belt 47. The primary cleaning device 45 removes the toner 9*a* that has remained on the surface of the photoconductor 41.

The secondary transfer device 48, in the conveyance path 30, transfers the toner image formed on the intermediate transfer belt 47 to the sheet. The secondary cleaning device 470 removes the toner 9*a* that has remained on the intermediate transfer belt 47.

It is noted that the primary transfer device 44, the intermediate transfer belt 47, and the secondary transfer device 48 constitute the transfer device that transfers the toner image on the photoconductor 41 to the sheet.

The fixing device 49 heats the toner image transferred to the sheet to fix the toner image to the sheet. The fixing device 49 includes a fixing roller that rotates while contacting the toner image formed on the sheet, and a heater that heats the fixing roller.

A low-melt-type toner may be adopted as the toner 9*a* of the developer 9, wherein the melting point of the low-melt-type toner is less than 150° C. In that case, in the fixing device 49, the set temperature for the heat control of the fixing roller by the heater may be equal to or less than 150° C. This contributes to reduction of the power consumption of the fixing device 49.

[Configuration of Developing Device 43]

Figure 2:
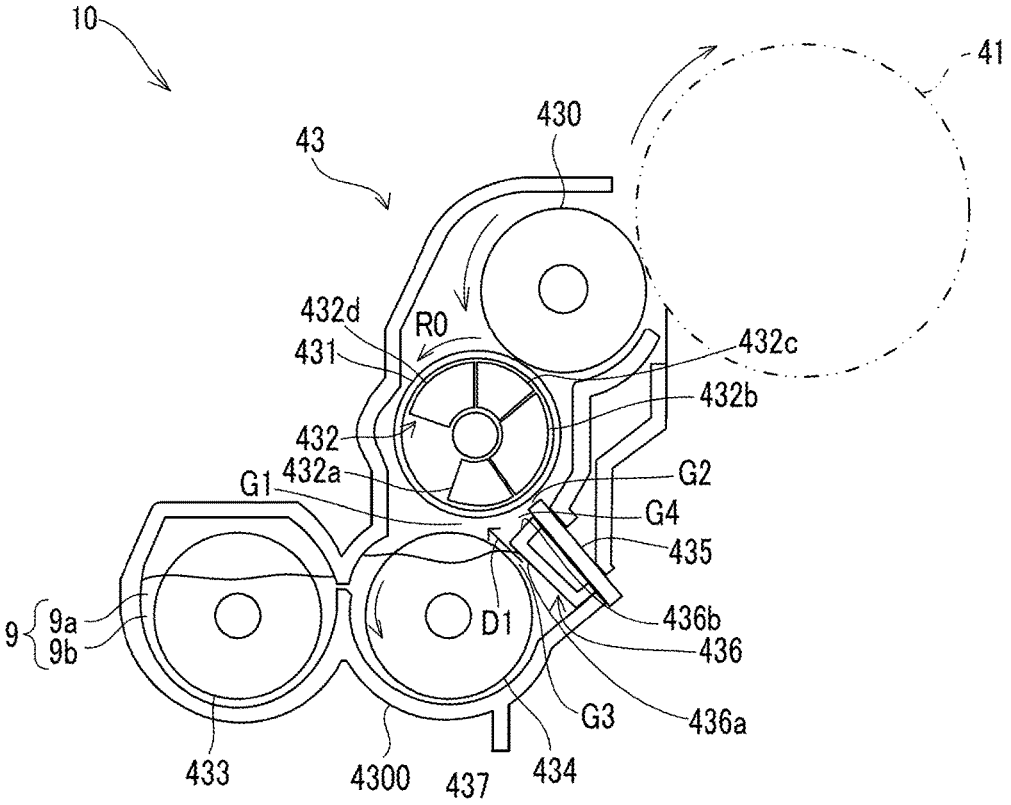
FIG. 2 is a configuration diagram of the developing device according to the first embodiment.

The developing device 43 shown in FIG. 2 is of a so-called interactive touch down system. The developing device 43 includes a storage portion 4300, a developing roller 430, a magnetic roller 431, a magnet 432, a first stirring screw 433, a second stirring screw 434, a blade 435, and a guide portion 436. The magnet 432 is disposed in a hollow portion of the cylindrical magnetic roller 431.

In the storage portion 4300 storing the developer 9, the developing roller 430, the magnetic roller 431, the first stirring screw 433, and the second stirring screw 434 rotate. The first stirring screw 433 and the second stirring screw 434 cyclically conveys the developer 9 in the storage portion 4300 while stirring it. The toner 9*a* is electrically charged by being stirred.

Figure 3:
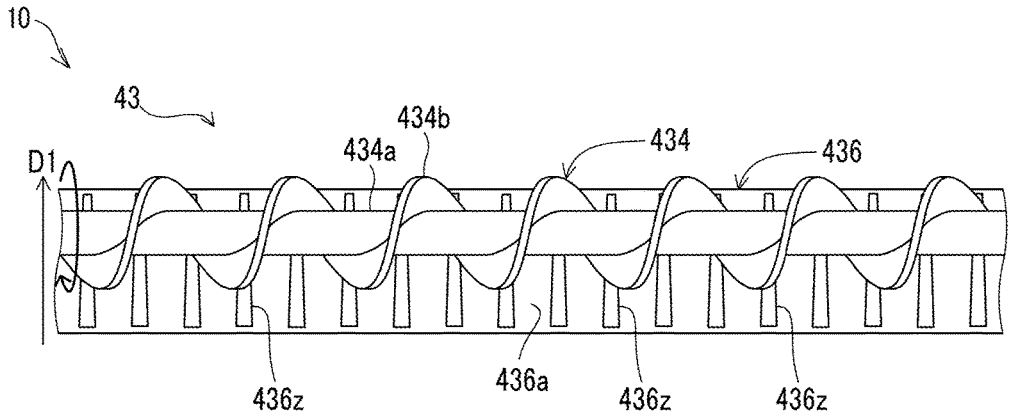
FIG. 3 is a front view of a stirring screw and a guide portion included in the developing device according to the first embodiment.

As shown in FIG. 3, the second stirring screw 434 is a stirring portion of a screw feeder type, and includes a shaft portion 434*a* and a blade portion 434*b* of a spiral shape. The second stirring screw 434 rotates around the shaft portion 434*a*. The blade portion 434*b* spirally extends outward from the shaft portion 434*a*. It is noted that the first stirring screw 433 has the same structure as the second stirring screw 434.

The second stirring screw 434 is disposed to face the magnetic roller 431 with a first gap G1 therebetween and rotates at the position. It is noted that the second stirring screw 434 is an example of the stirring portion that stirs the developer 9 in the storage portion 4300.

The second stirring screw 434 conveys the developer 9 to the first gap G1 while stirring the developer 9. This allows the developer 9 to be supplied to the magnetic roller 431.

The magnetic roller 431 having the magnet 432 in its inside rotates in a predetermined forward rotation direction R0 while carrying the two-component developer 9 on its outer circumferential surface. The magnetic roller 431 is configured to supply only the toner 9*a* among the developer 9 it carries, to the developing roller 430. It is noted that the magnetic roller 431 is an example of the developer carrying member.

The blade 435 is disposed on the downstream side of the second stirring screw 434 in the forward rotation direction R0 of the magnetic roller 431, to face the magnetic roller 431 with a second gap G2 therebetween. The blade 435 is disposed between the developing roller 430 and the second stirring screw 434 in the surrounding of the magnetic roller 431.

The magnet 432 includes a first magnetic pole portion 432*a*, a second magnetic pole portion 432*b*, a third magnetic pole portion 432*c*, and a fourth magnetic pole portion 432*d*, wherein the second magnetic pole portion 432*b* is adjacent to and on the downstream side of the first magnetic pole portion 432*a* in the forward rotation direction R0, the third magnetic pole portion 432*c* is adjacent to and on the downstream side of the second magnetic pole portion 432*b* in the forward rotation direction R0, and the fourth magnetic pole portion 432*d* is adjacent to and on the downstream side of the third magnetic pole portion 432*c* in the forward rotation direction R0.

The magnetic roller 431 carries the developer 9 by the magnetic force of the magnet 432 that is in the inside of the magnetic roller 431. That is, the first magnetic pole portion 432*a* magnetically attracts the developer 9, and the developer 9 is drawn up from the periphery of the second stirring screw 434 onto the outer circumferential surface of the magnetic roller 431 by the magnetic force of the first magnetic pole portion 432*a*.

The first magnetic pole portion 432*a* is disposed on the upstream side of the blade 435 in the forward rotation direction R0 of the magnetic roller 431. A part of the first magnetic pole portion 432*a* faces the second stirring screw 434 with the first gap G1 therebetween.

The blade 435 restricts the layer thickness of the developer 9 carried by the magnetic roller 431. By passing through the second gap G2, the layer thickness of the developer 9 on the outer circumferential surface of the magnetic roller 431 becomes approximately equal to the height of the second gap G2. It is noted that the blade 435 is an example of the layer thickness restricting portion.

The second magnetic pole portion 432*b* is disposed on the upstream side of a position on the magnetic roller 431 facing the developing roller 430, in the forward rotation direction R0 of the magnetic roller 431. A part of the second magnetic pole portion 432*b* faces the blade 435 with the magnetic roller 431 therebetween. The magnetic pole of the second magnetic pole portion 432*b* is different from the magnetic pole of the first magnetic pole portion 432*a*.

The developing roller 430 rotates while carrying, on its outer circumferential surface, the toner 9*a* supplied from the magnetic roller 431. Furthermore, the developing roller 430 supplies the toner 9*a* to the electrostatic latent image formed on the surface of the photoconductor 41. In this way, the developing roller 430 develops, as the toner image, the electrostatic latent image on the surface of the photoconductor 41.

The third magnetic pole portion 432*c* faces the developing roller 430 with the magnetic roller 431 therebetween. The magnetic pole of the third magnetic pole portion 432*c* is the same as the magnetic pole of the first magnetic pole portion 432*a*. In addition, the magnetic pole of the fourth magnetic pole portion 432*d* is different from the magnetic pole of the first magnetic pole portion 432*a*.

The carrier 9*b* on the magnetic roller 431 forms a magnetic brush by the magnetic field of the magnet 432. The magnetic brush comes to contact the outer circumferential surface of the developing roller 430. Upon contact, the toner 9*a* that has adhered to the carrier 9*b* transitions from the magnetic roller 431 to the developing roller 430.

The toner 9*a* then transitions from the developing roller 430 to the photoconductor 41 when the layer of the toner 9*a* carried by the developing roller 430 faces the electrostatic latent image on the photoconductor 41. The toner 9*a* that has remained on the developing roller 430 without transitioning to the photoconductor 41, is collected into the storage portion 4300.

Meanwhile, it is known that, on the outer circumferential surface of the magnetic roller 431, streaky density unevenness of the developer 9 is formed along the blade portion 434*b* of the second stirring screw 434. The density unevenness of the developer 9 occurs since the blade portion 434*b* of the second stirring screw 434 generates thickness distribution of the layer of the developer 9 in the axial direction of the magnetic roller 431.

In addition, there is known a conventional apparatus in which a restriction plate is disposed on the upstream side of the blade 435 in the forward rotation direction R0 of the magnetic roller 431, to face the outer circumferential surface of the magnetic roller 431, and a projection portion is formed on the surface of the restriction plate.

The restriction plate compresses the developer 9 carried by the magnetic roller 431. The projection portion moderates the density unevenness of the developer 9 on the outer circumferential surface of the magnetic roller 431.

There may be a case where, due to the miniaturization of the developing device 43, a passage of the developer 9 that is long enough to eliminate the density unevenness of the developer 9 cannot be secured between the magnetic roller 431 and the restriction plate.

It is noted that the toner 9*a* of the low melt type is likely to be deteriorated upon compression. Accordingly, it is preferable to moderate the density unevenness of the developer 9 on the outer circumferential surface of the magnetic roller 431 by applying as little pressure as possible to the developer 9.

The developing device 43 has a configuration that can moderate the density unevenness of the developer 9 due to the second stirring screw 434 on the outer circumferential surface of the magnetic roller 431, even if the peripheral space of the magnetic roller 431 is narrow. The following describes the configuration.

[Guide Portion 436]

The guide portion 436 is disposed between the second stirring screw 434 and the blade 435. In the example shown in FIG. 2, the guide portion 436 is attached to the blade 435 on a surface on the side of the second stirring screw 434. The guide portion 436 includes a first guide surface 436*a* facing the second stirring screw 434, and a second guide surface 436*b* facing the magnetic roller 431.

The first guide surface 436*a* faces the second stirring screw 434 with a third gap G3 therebetween. The third gap G3 is a passage through which the developer 9 passes toward the first gap G1. The first guide surface 436*a* guides, to the first gap G1, the developer 9 that is moved by the rotation of the second stirring screw 434.

The second guide surface 436*b* faces the magnetic roller 431 with a fourth gap G4 therebetween. The fourth gap G4 is a passage through which the developer 9 from the first gap G1 passes toward the second gap G2.

The fourth gap G4 gradually narrows from the first gap G1 side to the second gap G2 side. That is, the passage through which the developer 9 carried by the magnetic roller 431 passes toward the second gap G2 is made narrower by the second guide surface 436*b*. With this configuration, in the first gap G1, the second guide surface 436*b* guides the developer 9 that has moved from the peripheral of the second stirring screw 434 to the outer circumferential surface of the magnetic roller 431, to the second gap G2.

In the following description, a direction that is perpendicular to the longitudinal direction of the rotation shaft of the second stirring screw 434 and directs to the magnetic roller 431 when viewed from the front side of the first guide surface 436*a*, is referred to as a developer supply direction D1. When viewed from the front side of the first guide surface 436*a*, the blade portion 434*b* on its side facing the first guide surface 436*a* is displaced in the developer supply direction D1.

Figure 4:
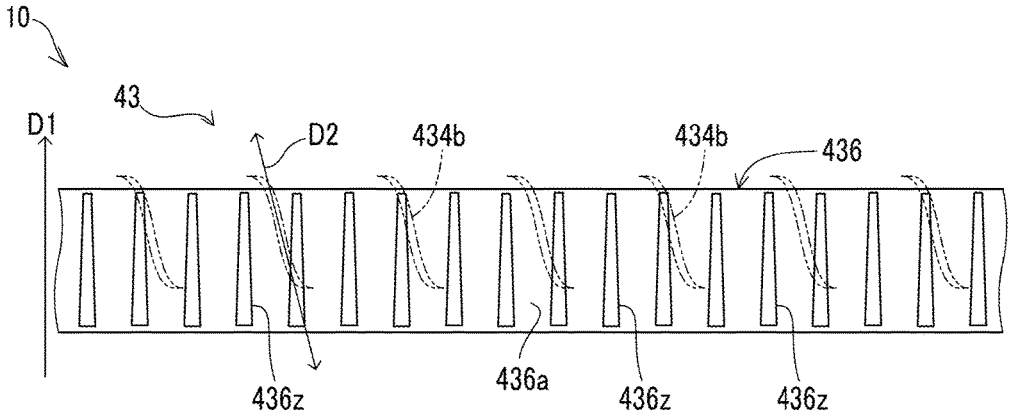
FIG. 4 is a front view of the guide portion included in the developing device according to the first embodiment.

As shown in FIG. 4, a plurality of convex portions 436*z* are formed on the first guide surface 436*a*. The plurality of convex portions 436*z* are formed in an area of the first guide surface 436*a* that extends from a position close to one of opposite ends of the rotation shaft of the second stirring screw 434 in the longitudinal direction of the rotation shaft, to a position close to the other end.

In the present embodiment, each of the plurality of convex portions 436*z* is formed in the tapered shape in which the width gradually narrows from the upstream side to the downstream side in the developer supply direction D1, along the developer supply direction D1 when viewed from the front side of the first guide surface 436*a*.

The plurality of convex portions 436*z* are arranged at intervals in alignment along the longitudinal direction of the rotation shaft of the second stirring screw 434, when viewed from the front side of the first guide surface 436*a*. It is noted that the height position of each of the plurality of convex portions 436*z* is constant in the developer supply direction D1.

In FIG. 4, the blade portions 434*b* of the second stirring screw 434 facing the first guide surface 436*a* are represented by an imaginary line. As shown in FIG. 4, the blade portions 434*b* facing the first guide surface 436*a* are slanted with respect to the developer supply direction D1, when viewed from the front side of the first guide surface 436*a*.

In the following description, a direction in which the blade portions 434*b* facing the first guide surface 436*a* are slanted with respect to the developer supply direction D1, is referred to as a blade slant direction D2.

Each of the plurality of convex portions 436*z* forms steps with respect to the first guide surface 436*a* at edges of opposite sides thereof, the steps extending in a direction intersecting the blade slant direction D2. With this configuration, when the developer 9 passes through the third gap G3, the developer 9 is stirred by the plurality of convex portions 436*z* in a direction where the density distribution of the developer 9 that would become high along the blade portion 434*b* is made substantially uniform.

Due to the above-described action of the plurality of convex portions 436*z*, the density unevenness of the developer 9 due to the second stirring screw 434 on the outer circumferential surface of the magnetic roller 431 is moderated. In addition, the configuration makes it possible to secure an enough length of the plurality of convex portions 436*z* in the developer supply direction D1 even when the peripheral space of the magnetic roller 431 is narrow, namely, even when the distance between the first gap G1 and the second gap G2 is short.

Second Embodiment

Figure 5:
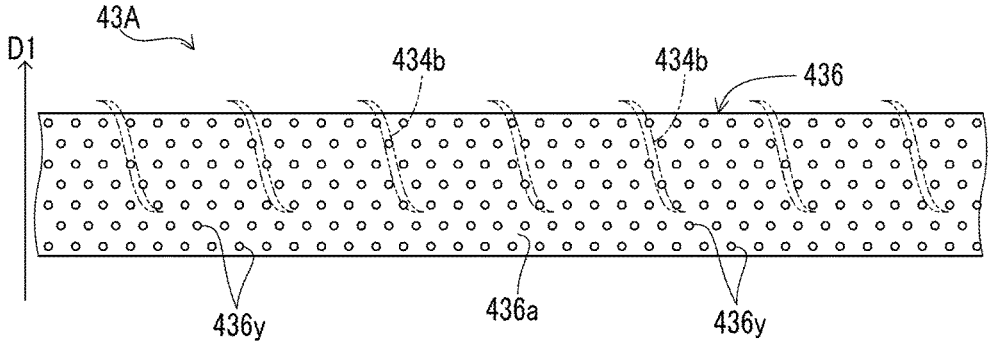
FIG. 5 is a front view of a guide portion included in the developing device according to a second embodiment.

Next, a description is given of a developing device 43A according to the second embodiment that is applicable to the image forming apparatus 10, with reference to FIG. 5. In FIG. 5, components that are the same as those shown in FIG. 1 to FIG. 4 are assigned the same reference signs.

A plurality of convex portions 436*y* are formed on the first guide surface 436*a* of the guide portion 436 of the developing device 43A. The plurality of convex portions 436*y* are formed in an area of the first guide surface 436*a* that extends from a position close to one of opposite ends of the rotation shaft of the second stirring screw 434 in the longitudinal direction of the rotation shaft, to a position close to the other end.

The plurality of convex portions 436*y* are different in shape and arrangement from the plurality of convex portions 436*z* formed on the first guide surface 436*a* of the guide portion 436 of the developing device 43. This is the difference between the developing device 43A and the developing device 43.

In the developing device 43A, the plurality of convex portions 436*y* are formed in a staggered arrangement on the first guide surface 436*a* of the guide portion 436. For example, the height position of each of the plurality of convex portions 436*y* may be equal.

In the example shown in FIG. 5, each of the convex portions 436*y* is cylindrical. It is noted that each of the convex portions 436*y* may have a polygonal shape in cross section.

Each of the plurality of convex portions 436*y*, in major portions of its outer circumference, forms a step with respect to the first guide surface 436*a*, and the steps are aligned along a direction intersecting the blade slant direction D2. With this configuration, when the developer 9 passes through the third gap G3, the developer 9 is stirred by the plurality of convex portions 436*y* in a direction where the density distribution of the developer 9 that would become high along the blade portion 434*b* is made substantially uniform.

Due to the above-described action of the plurality of convex portions 436*y*, the density unevenness of the developer 9 due to the second stirring screw 434 on the outer circumferential surface of the magnetic roller 431 is moderated.

Third Embodiment

Figure 6A:
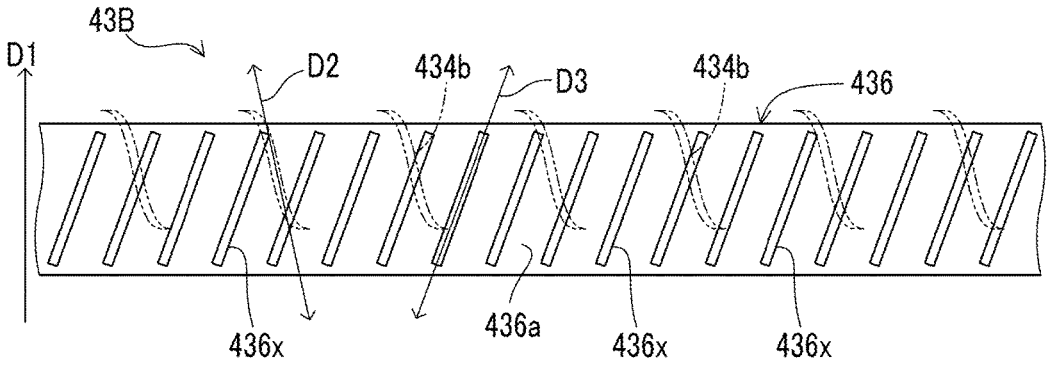
FIG. 6A and FIG. 6B are, respectively, a front view and a cross-sectional view of a guide portion included in the developing device according to a third embodiment.
Figure 6B:
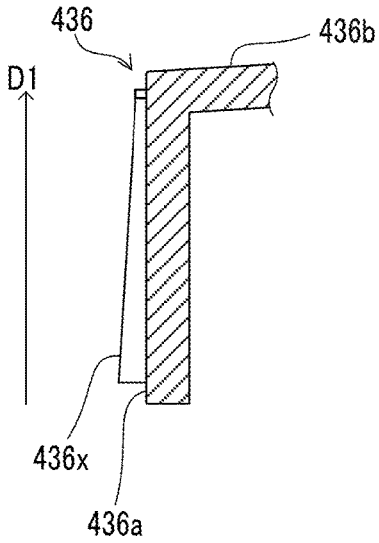

Next, a description is given of a developing device 43B according to the third embodiment that is applicable to the image forming apparatus 10, with reference to FIG. 6A and FIG. 6B. In FIG. 6A and FIG. 6B, components that are the same as those shown in FIG. 1 to FIG. 4 are assigned the same reference signs.

A plurality of convex portions 436*x* are formed on the first guide surface 436*a* of the guide portion 436 of the developing device 43B. The plurality of convex portions 436*x* are formed in an area of the first guide surface 436*a* that extends from a position close to one of opposite ends of the rotation shaft of the second stirring screw 434 in the longitudinal direction of the rotation shaft, to a position close to the other end.

The plurality of convex portions 436*x* are different in shape from the plurality of convex portions 436*z* formed on the first guide surface 436*a* of the guide portion 436 of the developing device 43.

In the developing device 43B, when viewed from the front side of the first guide surface 436*a*, the plurality of convex portions 436*x* are formed along an inversely slanted direction D3 that is slanted toward the opposite side of the blade slant direction D2 on the basis of the developer supply direction D1. The plurality of convex portions 436*x* are, as a whole, an example of the inversely slanted portion.

As shown in FIG. 6B, each of the plurality of convex portions 436*x* is formed in a taper shape in which the height thereof is gradually reduced from the upstream side to the downstream side in the developer supply direction D1. The developing device 43B produces substantially the same effect as the developing device 43 or 43A.

Fourth Embodiment

Figure 7A:
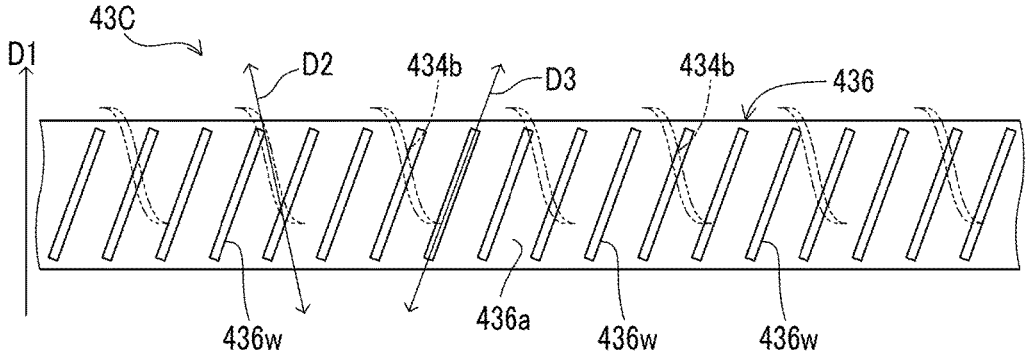
FIG. 7A and FIG. 7B are, respectively, a front view and a cross-sectional view of a guide portion included in the developing device according to a fourth embodiment.
Figure 7B:
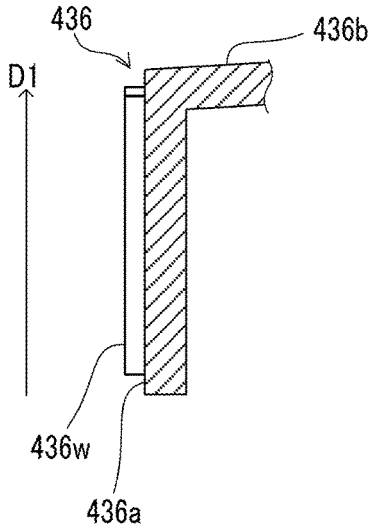

Next, a description is given of a developing device 43C according to the fourth embodiment that is applicable to the image forming apparatus 10, with reference to FIG. 7A and FIG. 7B. In FIG. 7A and FIG. 7B, components that are the same as those shown in FIG. 1 to FIG. 4 are assigned the same reference signs.

A plurality of convex portions 436*w* are formed on the first guide surface 436*a* of the guide portion 436 of the developing device 43C. The plurality of convex portions 436*w* are formed in an area of the first guide surface 436*a* that extends from a position close to one of opposite ends of the rotation shaft of the second stirring screw 434 in the longitudinal direction of the rotation shaft, to a position close to the other end.

The plurality of convex portions 436*w* are different in shape from the plurality of convex portions 436*z* formed on the first guide surface 436*a* of the guide portion 436 of the developing device 43.

In the developing device 43C, when viewed from the front side of the first guide surface 436*a*, the plurality of convex portions 436*w* are formed along the inversely slanted direction D3 on the basis of the developer supply direction D1, as is the case with the plurality of convex portions 436*x*. The plurality of convex portions 436*w* are, as a whole, an example of the inversely slanted portion.

As shown in FIG. 7B, the plurality of convex portions 436*w* are constant in height in the developer supply direction D1. The developing device 43C produces substantially the same effect as the developing device 43, 43A or 43B.

Fifth Embodiment

Figure 8:
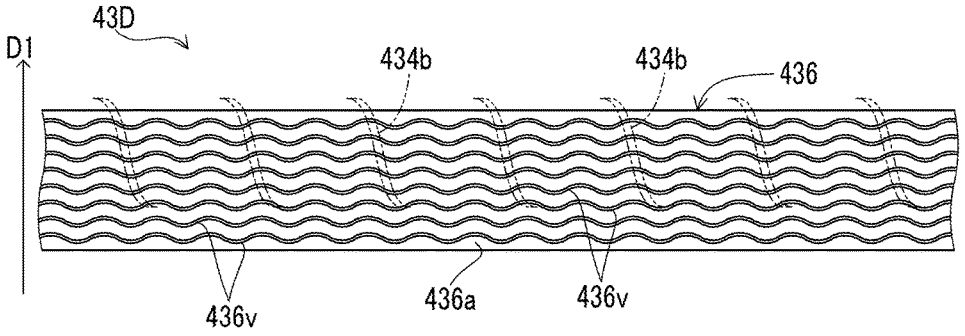
FIG. 8 is a front view of a guide portion included in the developing device according to a fifth embodiment.

Next, a description is given of a developing device 43D according to the fifth embodiment that is applicable to the image forming apparatus 10, with reference to FIG. 8. In FIG. 8, components that are the same as those shown in FIG. 1 to FIG. 4 are assigned the same reference signs.

A plurality of convex portions 436*v* are formed on the first guide surface 436*a* of the guide portion 436 of the developing device 43D. The plurality of convex portions 436*v* are formed in an area of the first guide surface 436*a* that extends from a position close to one of opposite ends of the rotation shaft of the second stirring screw 434 in the longitudinal direction of the rotation shaft, to a position close to the other end.

The plurality of convex portions 436*v* are different in shape from the plurality of convex portions 436*z* formed on the first guide surface 436*a* of the guide portion 436 of the developing device 43.

In the developing device 43D, each of the plurality of convex portions 436*v* is formed in the shape of a wave that extends in the longitudinal direction of the rotation shaft of the second stirring screw 434. When viewed from the front side of the first guide surface 436*a*, the plurality of convex portions 436*v* are formed at intervals in the developer supply direction D1.

The plurality of convex portions 436*v* are constant in height position in the longitudinal direction of the rotation shaft of the second stirring screw 434. The developing device 43D produces substantially the same effect as the developing device 43, 43A, 43B or 43C.

Sixth Embodiment

Figure 9:
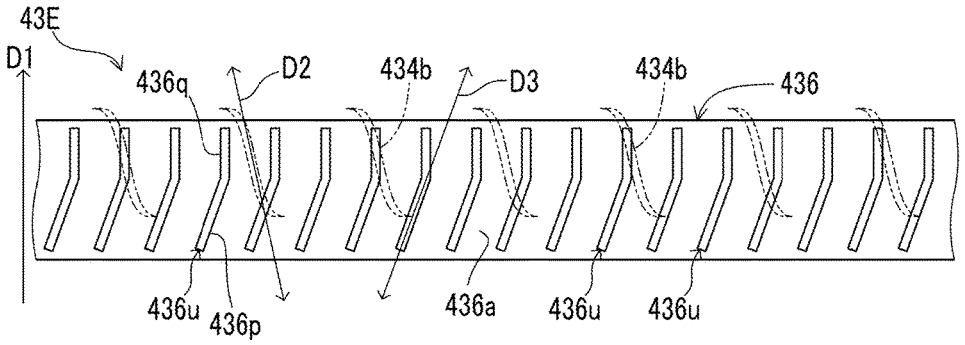
FIG. 9 is a front view of a guide portion included in the developing device according to a sixth embodiment.

Next, a description is given of a developing device 43E according to the sixth embodiment that is applicable to the image forming apparatus 10, with reference to FIG. 9. In FIG. 9, components that are the same as those shown in FIG. 1 to FIG. 4 are assigned the same reference signs.

A plurality of convex portions 436*u* are formed on the first guide surface 436*a* of the guide portion 436 of the developing device 43D. The plurality of convex portions 436*u* are formed in an area of the first guide surface 436*a* that extends from a position close to one of opposite ends of the rotation shaft of the second stirring screw 434 in the longitudinal direction of the rotation shaft, to a position close to the other end.

The plurality of convex portions 436*u* are different in shape from the plurality of convex portions 436*z* formed on the first guide surface 436*a* of the guide portion 436 of the developing device 43.

When viewed from the front side of the first guide surface 436*a*, the plurality of convex portions 436*u* are formed at intervals in the longitudinal direction of the rotation shaft of the second stirring screw 434.

In the developing device 43E, each of the plurality of convex portions 436*u* includes a first portion 436*p* and a second portion 436*q*. When viewed from the front side of the first guide surface 436*a*, the first portion 436*p* of each convex portion 436*u* is formed along the inversely slanted direction D3 that is slanted on the basis of the developer supply direction D1. The first portion 436*p* of each convex portion 436*u* is an example of the inversely slanted portion.

When viewed from the front side of the first guide surface 436*a*, the second portion 436*q* of each convex portion 436*u* is formed along the developer supply direction D1. The plurality of convex portions 436*u* are constant in height in the developer supply direction D1. The developing device 43E produces substantially the same effect as the developing device 43, 43A, 43B, 43C or 43D.

Seventh Embodiment

Figure 10:
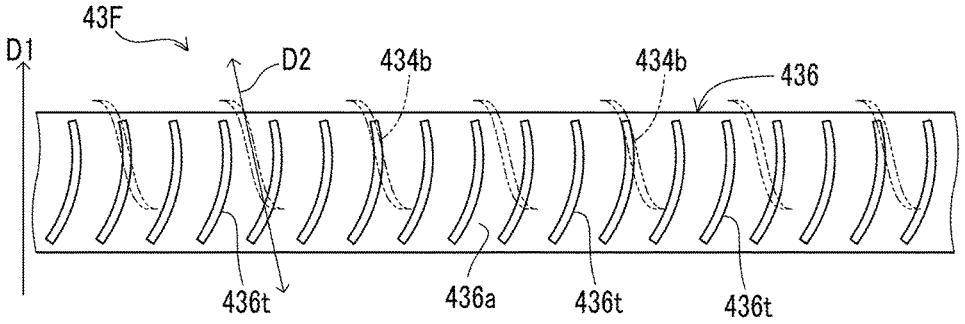
FIG. 10 is a front view of a guide portion included in the developing device according to a seventh embodiment.

Next, a description is given of a developing device 43F according to the seventh embodiment that is applicable to the image forming apparatus 10, with reference to FIG. 10. In FIG. 10, components that are the same as those shown in FIG. 1 to FIG. 4 are assigned the same reference signs.

A plurality of convex portions 436*t* are formed on the first guide surface 436*a* of the guide portion 436 of the developing device 43F. The plurality of convex portions 436*t* are formed in an area of the first guide surface 436*a* that extends from a position close to one of opposite ends of the rotation shaft of the second stirring screw 434 in the longitudinal direction of the rotation shaft, to a position close to the other end.

The plurality of convex portions 436*t* are different in shape from the plurality of convex portions 436*z* formed on the first guide surface 436*a* of the guide portion 436 of the developing device 43.

When viewed from the front side of the first guide surface 436*a*, the plurality of convex portions 436*t* are formed at intervals in the longitudinal direction of the rotation shaft of the second stirring screw 434.

In the developing device 43F, when viewed from the front side of the first guide surface 436*a*, each of the plurality of convex portions 436*t* is formed along a curved line that intersects the blade slant direction D2. For example, the plurality of convex portions 436*t* are constant in height in the developer supply direction D1. The developing device 43F produces substantially the same effect as the developing device 43, 43A, 43B, 43C, 43D or 43E.

Eighth Embodiment

Figure 11:
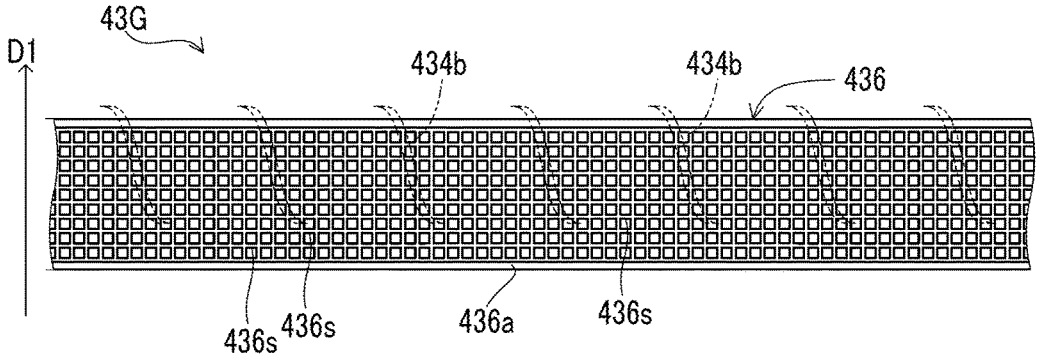
FIG. 11 is a front view of a guide portion included in the developing device according to an eighth embodiment.

Next, a description is given of a developing device 43G according to the eighth embodiment that is applicable to the image forming apparatus 10, with reference to FIG. 11. In FIG. 11, components that are the same as those shown in FIG. 1 to FIG. 4 are assigned the same reference signs.

A plurality of convex portions 436*s* are arranged in a lattice shape on the first guide surface 436*a* of the guide portion 436 of the developing device 43G. That is, the plurality of convex portions 436*s* include portions that form vertical frames of the lattice along the developer supply direction D1, and portions that form horizontal frames of the lattice along the longitudinal direction of the rotation shaft of the second stirring screw 434.

It may be said that the first guide surface 436*a* of the developing device 43G is composed of a plurality of rectangular concave portions that are formed along the longitudinal direction of the rotation shaft of the second stirring screw 434, and along the developer supply direction D1.

The plurality of convex portions 436*s* are formed in an area of the first guide surface 436*a* that extends from a position close to one of opposite ends of the rotation shaft of the second stirring screw 434 in the longitudinal direction of the rotation shaft, to a position close to the other end.

The developing device 43G produces substantially the same effect as the developing device 43, 43A, 43B, 43C, 43D, 43E or 43F.

[Results of Evaluation Experiment]

The following describes results of an evaluation experiment in which a comparison was made between a comparative device whose first guide surface 436*a* and second guide surface 436*b* of the guide portion 436 are flat, and the developing devices 43, 43A, 43B, 43C, 43D, 43E, 43F and 43G.

In general, when the amount of the developer 9 in the storage portion 4300 becomes small, the density unevenness of the developer 9 due to the second stirring screw 434 is likely to occur. Furthermore, the density unevenness of the developer 9 due to the second stirring screw 434 is more likely to occur when the print process has been executed a number of times and the developer 9 has been deteriorated, than when the developer 9 is new.

In the evaluation experiment, a test printing was performed under a plurality of conditions where the set amount of the developer 9 in the storage portion 4300 was gradually reduced by 10 grams, so as to detect, among conditions under which a print with no density unevenness due to the second stirring screw 434 was obtained, a condition with the smallest amount of the developer 9. Hereinafter, the amount of the developer 9 set for the detected condition is referred to as a "limit amount". Here, it can be said that the smaller the limit amount is, the less the density unevenness due to the second stirring screw 434 is likely to occur.

In addition, the evaluation experiment was conducted in an initial state where the developer 9 was new, and in a 100,000-sheets printed state where the print process had been performed on 100,000 sheets.

When the limit amount of the developer 9 in the comparative device in the initial state was 100%, the limit amounts of the developing devices 43, 43A, 43B, 43C, 43D, 43E, 43F and 43G were, respectively, 77%, 82%, 82%, 86%, 86%, 82%, 82%, and 91%.

In addition, when the limit amount of the developer 9 in the comparative device in the 100,000-sheets printed state was 100%, the limit amounts of the developing devices 43, 43A, 43B, 43C, 43D, 43E, 43F and 43G were, respectively, 79%, 79%, 79%, 83%, 83%, 83%, 83%, and 88%.

The results of the evaluation experiment indicate that, in the developing devices 43, 43A, 43B, 43C, 43D, 43E, 43F and 43G, compared to the comparative device, the density unevenness due to the second stirring screw 434 is difficult to occur even when the amount of the developer 9 in the storage portion 4300 becomes small.

It is noted that when the limit amount of the developer 9 in the comparative device in the initial state was 100%, the limit amount of the developer 9 in the comparative device in the 100,000-sheets printed state was 109%.

First Application Example

In the developing devices 43, 43A, 43B, 43C, 43D, 43E, 43F and 43G, the plurality of convex portions 436*z*, 436*y*, 436*x*, 436*w*, 436*v*, 436*u*, 436*t* and 436*s* may be further formed on the second guide surface 436*b* of the guide portion 436. In that case, the direction oriented from the first gap G1 to the second gap G2 on the second guide surface 436*b* corresponds to the developer supply direction D1.

Second Application Example

In the developing devices 43, 43A, 43B, 43C, 43D, 43E, 43F and 43G, the plurality of convex portions 436*z*, 436*y*, 436*x*, 436*w*, 436*v*, 436*u*, 436*t* and 436*s* form convexes and concaves on the first guide surface 436*a*.

On the other hand, when viewed from the front side of the first guide surface 436*a*, a plurality of concave portions having the same outline shapes as the plurality of convex portions 436*z*, 436*y*, 436*x*, 436*w*, 436*v*, 436*u*, 436*t* and 436*s* may be formed on the first guide surface 436*a* instead of the plurality of convex portions 436*z*, 436*y*, 436*x*, 436*w*, 436*v*, 436*u*, 436*t* and 436*s*.

Furthermore, in the present application example, the plurality of concave portions may be formed on both the first guide surface 436*a* and the second guide surface 436*b*.

In the case where the plurality of concave portions are formed on the first guide surface 436*a*, concaves and convexes are formed on the first guide surface 436*a*. This case, too, produces substantially the same effect as the cases where the developing devices 43, 43A, 43B, 43C, 43D, 43E, 43F or 43G are adopted.

For example, a plurality of groove-like concave portions extending along the inversely slanted direction D3 may be formed on the first guide surface 436*a* instead of the plurality of convex portions 436*x* shown in FIG. 6A. In this case, each of the plurality of groove-like concave portions may be formed in the shape of a groove that becomes shallow gradually from the upstream side to the downstream side in the developer supply direction D1.

It is noted that the developing device and the image forming apparatus of the present disclosure may be configured by freely combining, within the scope of claims, the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing device comprising:

a storage portion storing developer including toner;

a developer carrying member of a cylindrical shape having a magnet in an inside thereof and configured to rotate in the storage portion while carrying the developer on an outer circumferential surface thereof;

a stirring portion including a blade portion spirally extending outward, the stirring portion facing the developer carrying member with a first gap therebetween and stir the developer in the storage portion by rotating;

a layer thickness restricting portion located on a downstream side of the stirring portion in a rotation direction of the developer carrying member, the layer thickness restricting portion facing the developer carrying member with a second gap therebetween and restricting a layer thickness of the developer carried by the developer carrying member; and a guide portion disposed between the stirring portion and the layer thickness restricting portion, wherein the guide portion includes:

a first guide surface on which a plurality of convex portions or a plurality of concave portions are formed, the first guide surface facing the stirring portion with a third gap therebetween, the third gap being a passage through which the developer passes toward the first gap; and a second guide surface facing the developer carrying member with a fourth gap therebetween, the fourth gap being a passage through which the developer passes toward the second gap.

2. The developing device according to claim 1, wherein each of the plurality of convex portions formed on the first guide surface is formed to extend along a developer supply direction in a tapered shape in which its width gradually narrows from an upstream side to a downstream side in the developer supply direction which, when viewed from a front side of the first guide surface, is perpendicular to a longitudinal direction of a rotation shaft of the stirring portion and extends toward the developer carrying member.

3. The developing device according to claim 1, wherein the plurality of convex portions are formed in a staggered arrangement on the first guide surface.

4. The developing device according to claim 1, further comprising:

an inversely slanted portion in which each of the plurality of convex portions formed on the first guide surface is formed along an inversely slanted direction that is slanted toward an opposite side of a direction in which the blade portion facing the first guide surface is slanted with respect to a developer supply direction which, when viewed from a front side of the first guide surface, is perpendicular to a longitudinal direction of a rotation shaft of the stirring portion and extends toward the developer carrying member.

5. The developing device according to claim 4, wherein each of the plurality of convex portions formed on the first guide surface is formed in a tapered shape in which its height gradually lowers from an upstream side to a downstream side in the developer supply direction.

6. The developing device according to claim 1, wherein each of the plurality of convex portions formed on the first guide surface is, when viewed from a front side of the first guide surface, formed in a shape of a wave that extends in a longitudinal direction of a rotation shaft of the stirring portion.

7. The developing device according to claim 1, wherein the plurality of the convex portions or the plurality of the concave portions are further formed on the second guide surface.

8. An image forming apparatus comprising:

an image carrying member on whose surface an electrostatic latent image is formed;

the developing device according to claim 1 configured to develop, as a toner image, the electrostatic latent image on the surface of the image carrying member;

a transfer device configured to transfer the toner image to a sheet; and a fixing device configured to heat the toner image transferred to the sheet.

9. The image forming apparatus according to claim 8, wherein a set temperature for a heat control of the fixing device is equal to or less than 150° C.

* * * * *